United States Patent [19]

Kobayashi et al.

[11] 4,162,395

[45] Jul. 24, 1979

[54] HEATING UNIT FOR HEATING FLUID

[75] Inventors: Takashi Kobayashi; Toshikazu Nakamura, both of Yokaichi, Japan

[73] Assignee: Murata Manufacturing Co., Ltd., Kyoto, Japan

[21] Appl. No.: 692,526

[22] Filed: Jun. 3, 1976

[30] Foreign Application Priority Data

Nov. 7, 1975 [JP] Japan ..... 50-152141[U]

[51] Int. Cl.[2] ..... H05B 3/14

[52] U.S. Cl. ..... 219/367; 219/370; 219/375; 219/504; 219/536; 219/537

[58] Field of Search ..... 219/374, 375, 376, 381, 219/382, 532, 536, 537, 504, 505, 370, 342, 213, 345, 307, 537, 538, 539, 541, 542, 543, 548, 549, 552, 299, 338, 352, 366, 367, 369, 520, 528, 546, 553, 508; 388/22, 220, 23, 53, 55, 57, 295, 318, 319, 320, 327, 212, 314; 338/211

[56] References Cited

U.S. PATENT DOCUMENTS

| | | | |
|---|---|---|---|
| 330,449 | 11/1885 | Weston | 388/57 |
| 760,076 | 5/1904 | Leonard | 219/376 |
| 2,340,097 | 1/1944 | Woodman | 219/549 |
| 2,392,712 | 1/1946 | Woodman | 219/508 |
| 2,758,256 | 8/1956 | Eisler | 338/327 |
| 2,861,163 | 11/1958 | Asakawa | 219/504 |
| 3,086,187 | 4/1963 | Duggan et al. | 219/375 |
| 3,163,841 | 12/1964 | Willett | 219/374 |
| 3,287,684 | 11/1966 | Armbruster, Jr. | 219/549 |
| 3,348,020 | 10/1967 | Cooper | 219/374 |
| 3,594,547 | 7/1971 | Quinn | 338/211 |
| 3,781,526 | 12/1973 | Damron | 219/549 |
| 3,798,417 | 3/1974 | Bittner | 219/375 |
| 3,858,149 | 12/1974 | Kirilloff | 338/57 |
| 4,034,207 | 7/1977 | Tamada et al. | 219/504 |

*Primary Examiner*—J. V. Truhe
*Assistant Examiner*—Bernard Roskoski
*Attorney, Agent, or Firm*—Birch, Stewart, Kolasch & Birch

[57] ABSTRACT

The present disclosure relates to a heating unit for heating fluid such as air, in which a plurality of positive temperature coefficient (PTC) semiconductors are aligned in parallel to define clearances between each PTC semiconductor for the passage of the fluid. Each PTC semiconductor is provided with two electrodes disposed on the surface thereof for rapidly generating heat therefrom.

8 Claims, 14 Drawing Figures

FIG. 12
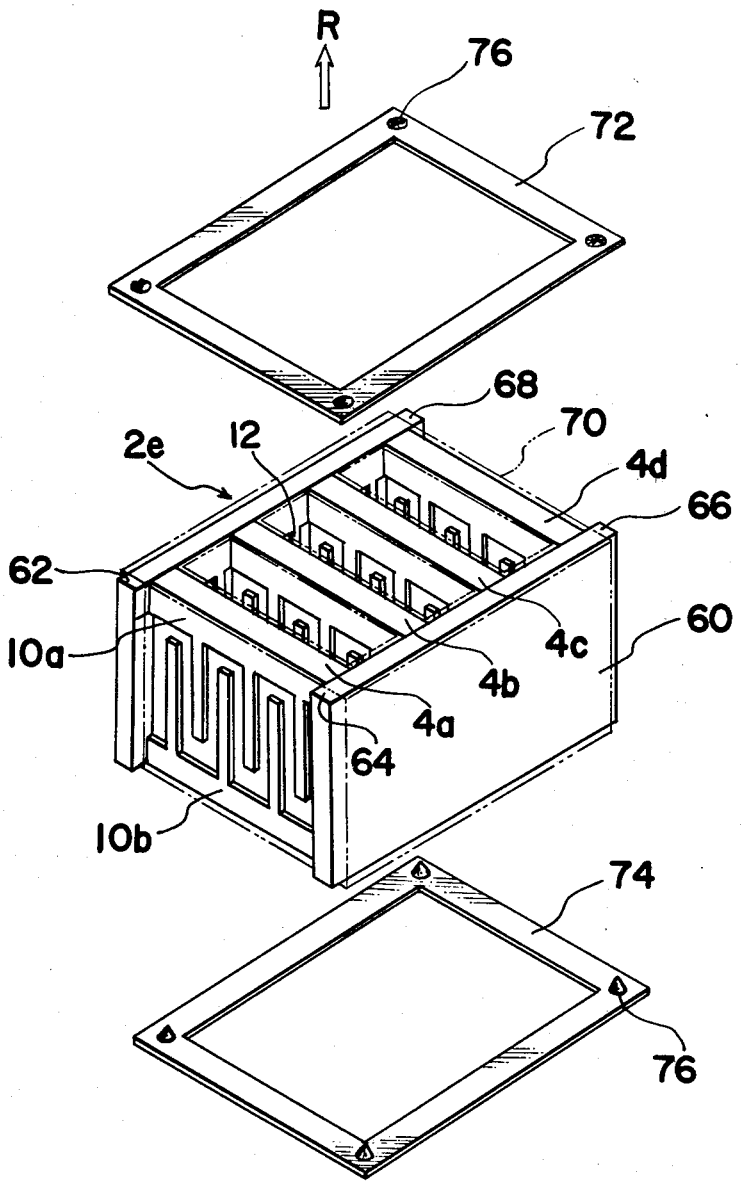
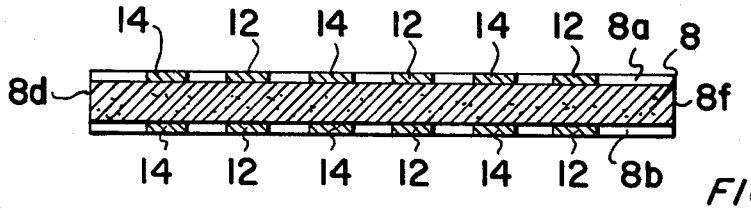
FIG. 5

HEATING UNIT FOR HEATING FLUID

BACKGROUND OF THE INVENTION

1. Field of the Invention

The present invention relates to a heating unit for use in a heater or drier, and more particularly to a device for heating fluid, in which is incorporated a heating unit having positive temperature coefficient PTC semiconductors for heating fluid passing thereby.

2. Description of Prior Art

Such PTC semiconductors can be employed as a heating means, in which electrical energy is converted into thermal energy. When a suitable voltage is applied to the PTC semiconductors material, such as a thermistor, the current flowing therethrough is comparatively high at an initial stage, so that the PTC semiconductor material is heated rapidly up to a certain temperature, which is in relation to the applied voltage. Thereafter, the current drops to a low value to reduce heat generation from the PTC semiconductor, thus maintaining a predetermined temperature.

It is known to use above described PTC semiconductor in the heaters for a heating unit, in which fluid such as air or liquid to be heated passes closely by the PTC semiconductor, thus obtaining heat therefrom.

Referring to FIG. 1, showing a conventional type of heating unit a, in which a plurality of PTC semiconductor heating elements b are aligned in parallel and spaced relation to each other and are supported by four corner bars c1 to c4. Each PTC semiconductor heating element b comprises a PTC semiconductor heating body d having rectangular shaped and parallel opposing faces and a pair of electrodes e1 and e2 provided at opposite edges of the PTC semiconductor heating body d, as most clearly seen in FIG. 2. Since the corner bars are made of electrically conductive material, the corner bars c1 and c2 electrically connect respective electrodes, say electrodes e1, while the corner bars c3 and c4 electrically connect the other electrodes e2. When a suitable voltage is applied between the electrodes e1 and e2 through the corresponding corner bars, the electrical current flows through the PTC semiconductor heating body d both in the inner region and at the outer region of the PTC semiconductor heating body d, thus energizing the whole PTC semiconductor heating body d to generate heat therefrom. Therefore, it is considered that the heat to be emitted from the PTC semiconductor heating body d is generated at the center o, thereof, as shown in FIG. 3. In other words, a heat generating origin x coincides with the center o. Since the generated heat is only emitted from the outer surface of the PTC semiconductor heating body d, it is preferable to have the heat generating origin x on the surfaces of the PTC semiconductor heating body d for rapidly emitting heat from the PTC semiconductor heating element b rapidly responding to the ambient temperature.

SUMMARY OF THE INVENTION

Therefore, it is a primary object of the present invention to present an improved type of heating unit employing PTC semiconductor heating elements which efficiently produces heat from the surfaces of the PTC semiconductor heating body.

It is another object of the present invention to present a heating unit of the above described type in which the PTC semiconductor heating elements to be incorporated therein can be easily positioned and fixedly placed by the corner bars in the heating device.

It is further object of the present invention to present a heating unit of the above described type which efficiently produces heat and rapidly responds to the ambient temperature.

It is still further object of the present invention to present a heating unit of the above described type which is simple in construction, and can readily be manufactured.

According to the present invention, the heating unit to be incorporated in the heating device comprises a plurality of PTC semiconductor heating elements, which are aligned in parallel and spaced relation to each other between four corner bars having L-shaped cross section for supporting the heating elements at their corners. Each PTC semiconductor heating element comprises a PTC semiconductor heating body having rectangular shaped and parallel opposed flat faces and two sets of alternately disposed electrodes provided on at least one of the flat faces of the PTC semiconductor heating body. Each electrode has a plurality of strips in a finger or fork-like shape, in which each strip is disposed in such a manner that neighboring strips are separated by a predetermined distance while said neighboring strips are members of opposite sets of electrodes. For providing such type of electrodes on both of the flat faces of the PTC semiconductor body, it is necessary to have the strips of the same electrodes to be exactly overlap each other through the PTC semiconductor heating body. When a suitable voltage is applied between the electrodes, the electrical current flows between the neighboring strips in a region predominantly near the surfaces of the PTC semiconductor heating body, thus only a thin outer region of the PTC semiconductor body between the two opposite electrodes acts as the thermal energy generating region, thereby enabling quick response of the heat emission to take place in relation to the electrical currents. Accordingly, the heat generating region x can be considered to be existing on the surfaces of the PTC semiconductor heating element.

Further particulars of the present invention lie in positioning and fixing means of the PTC semiconductor heating element, on the corner bars at predetermined positions in the heating unit.

When positioning the PTC semiconductor heating elements on the corner bars, prearranged recesses or cut-out portions or projections formed in the corner bars engage with each of the PTC semiconductor heating elements at their corners where the electrodes are provided, thus enabling exact positioning of the PTC semiconductor heating elements. The suitably positioned PTCS heating elements can be fixed thereat by means of soldering, sputtering or flame spraying using electrically conductive material.

The heating unit of the present invention can be further provided with walls or panels at the opposite side of the heating unit, thus guiding the fluid to flow through the heating unit exactly between the PTC semiconductor heating elements.

Each of the above described panels can be replaced by PTC semiconductor heating elements having two opposite electrodes in the above described manner on only inner surface which is facing the PTC semiconductor heating elements thus obtaining more heat producing area in the heating unit.

For the purpose of preventing the PTC semiconductor heating elements from deterioration which is often ccaused by the moisture or chemical substances contained in the fluid to be heated, the heating unit can be enclosed by a thin layer of electrically insulating material.

BRIEF DESCRIPTION OF THE DRAWINGS

These and other objects and features of the present invention will become apparent from the following description taken in conjunction with preferred embodiments thereof with reference to the accompanying drawings, wherein;

FIG. 5*b* is a cross sectional view taken along the line V—V shown in FIG. 5*a;*

FIG. 12 is a similar view to FIG. 11, but particularly showing the heating unit with electrically insulating material coated thereon.

Before the description of the present invention proceeds, it is to be noted that like elements are designated by like reference numerals throughout the views of the attached drawings.

DETAILED DESCRIPTION OF THE PREFERRED EMBODIMENTS

Figure 1:
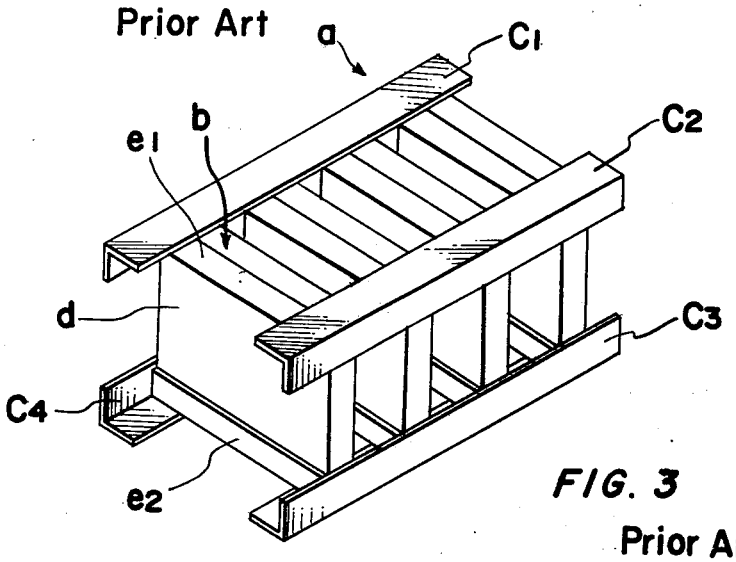
FIG. 1 Prior Art
FIGS. 1 to 3 illustrate prior art fluid heaters of the heaters of the type discussed hereinbefore
Figure 2:
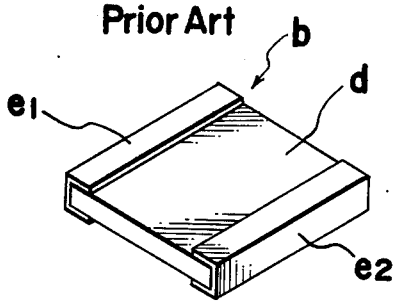
FIG. 2 Prior Art
Figure 3:
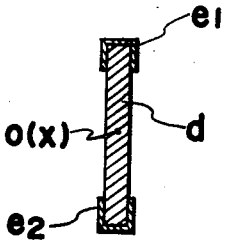
FIG. 3 Prior Art
Figure 4:
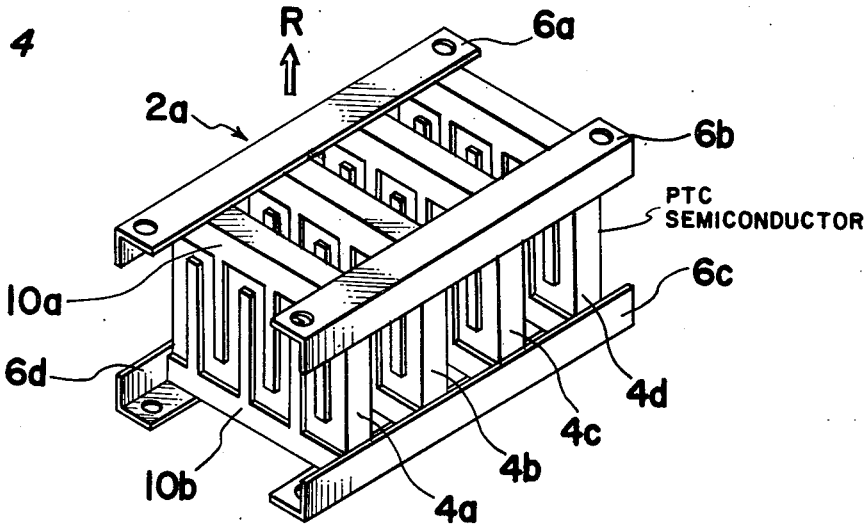
FIG. 4 is a perspective view of the heating unit of the present invention.
Figure 5A:
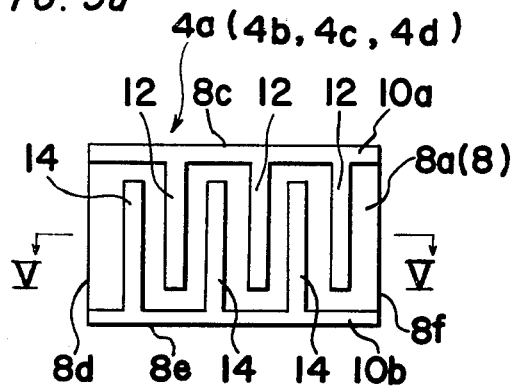
FIG. 5*a* is a top plan view of a heating element employed in the unit of FIG. 4.

Referring to FIGS. 4 to 5*b*, there is shown in FIG. 4 a heating unit 2*a* of the present invention, comprising four pieces of positive temperature coefficient PTC semiconductor heating elements 4*a*, 4*b*, 4*c* and 4*d* and four members of supporting bars or corner bars 6*a*, 6*b*, 6*c* and 6*d* which are made of electrically conductive material, each having an L-shaped cross section for supporting the four PTC semiconductor heating elements and bonded to the corners of the four PTC semiconductor heating elements. Each of the PTC semiconductor heating elements 4*a* to 4*d* comprises a PTCS heating body 8 and two sets of electrodes 10*a* and 10*b* as most clearly seen in FIGS. 5*a* and 5*b*. The PTC semiconductor heating body 8 has a rectangular shape with two opposite flat and mutually parallel faces 8*a* and 8*b* and two pairs of opposing perimeter faces 8*c*, 8*d*, 8*e* and 8*f*. Provided on the perimeter face 8*c* is the electrode 10*a* made of a thin layer of metallic film and having fork or finger-like extending portions, generally called strips 12 bonded on the faces 8*a* and 8*b*. It should be noted that the strips 12 provided on the face 8*a* exactly match or overlap through the PTC semiconductor heating body 8 with those strips 12 provided on the face 8*b*. In the similar manner, the perimeter face 8*e* is provided with the electrode 10*b* which is also made of thin layer of metallic film and has extending strips 14 bonded on the faces 8*a* and 8*b*, in the spaces between the strips 12, so that each strip is alternately disposed in such a manner that neighboring strips are separated by a predetermined distance while said neighboring strips are members of opposite sets of electrodes. Tips of each of the strips are also separated from the opposite electrode by said predetermined distance.

It should be noted that the strips 12 provided on the face 8*a* described as exactly match or overlap through the PTC semiconductor heating body 8 with those strips 12 provided on the face 8*b*, but do not necessarily have to overlap with those strips 12 provided on the face 8*b* when the thickness of the PTC semiconductor body is comparatively large, since the electrical current component through the thickness direction of the body is considered to be neslible therein, and also the strips 12 described, as provided on the faces 8*a* and 8*b*, can be provided only on either face 8*a* or 8*b*.

Figure 6A:
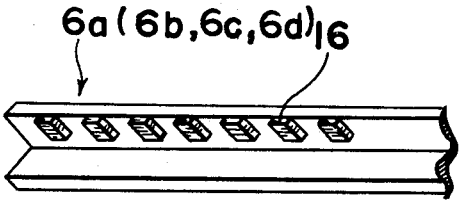
FIG. 6*a* is a fragmentary perspective view of the corner bar particularly showing projections formed therein.
Figure 6B:
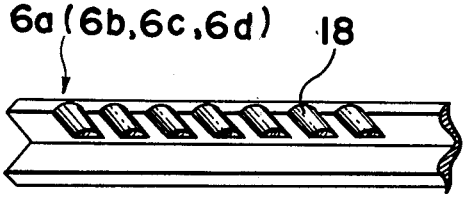
FIG. 6*b* is a similar view to FIG. 6*a*, but particularly showing recesses formed therein.

Referring to FIG. 6*a*, the corner bars 6*a* to 6*d* can be formed with a plurality of projections 16 at the inner face thereof for ensuring precise engagement of the PTC semiconductor heating elements with respective corner bars. For the purpose of the precise engagement with the PTC semiconductor heating elements, such projections 16 can be replaced by recesses 18 formed on the inner faces of the corner bars, as shown in FIG. 6*b*. Such projections and recesses are provided for positioning each of the PTC semiconductor heating elements in predetermined positions by engaging the corners of the PTC semiconductor heating elements thereat.

Referring again to FIG. 4, the two corner bars 6*a* and 6*b* engage with four pieces of PTC semiconductor heating elements at their opposite edges of the perimeter face 8*c*, while the other two corner bars 6*c* and 6*d* engage with the four PTC semiconductor heating elements at their opposite edges of the perimeter face 8*e* in such a manner that the four pieces of the PTC semiconductor heating elements are aligned in parallel to each other and are separated from each other by a predetermined distance and that the pair of electrodes of the PTC semiconductor heating elements are connected in parallel by the corner bars.

It should be noted that the number of the PTC semiconductor heating elements described as composed of four can be any other number with respect to the necessary degrees of the temperature needed to heat the air to predetermined temperatures.

Figure 7:
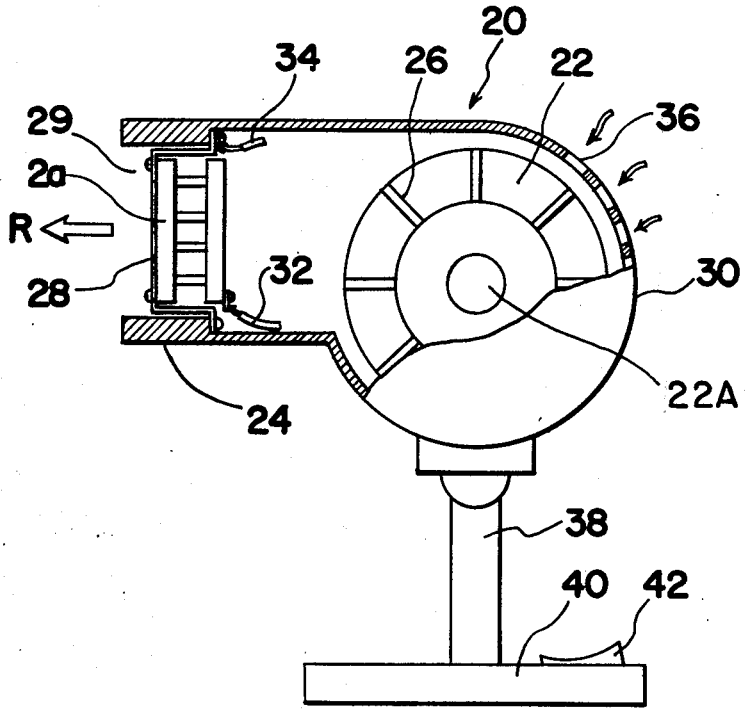
FIG. 7 is a side elevational view partly broken away of a heating device employing the above described heating unit therein.

It should also be noted that a pair of corner bars 6*a* and 6*b*, can be utilized as corner supporting members of the respective electrodes by integrally or fixedly forming connecting rod or rods (not shown) between the corner bars 6*a* and 6*b* at positions such as through the apertures in their opposite end portions to facilitate easy installation of the PTC semiconductor heating elements thereto in a predetermined parallel spaced relationship;

The above described heating unit 2*a* is employed in a device for heating fluid such as air, as shown in FIG. 7.

Figure 8:
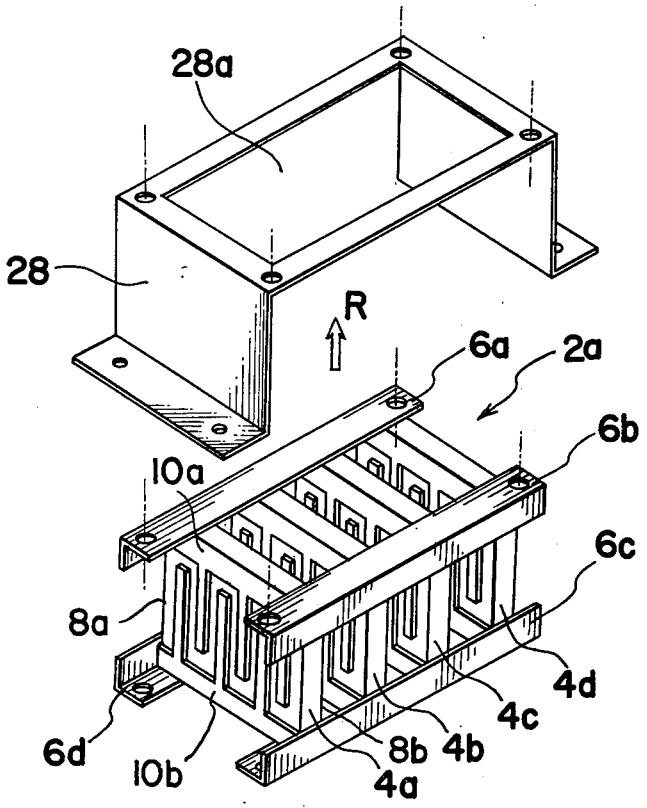
FIG. 8 is an exploded view of the heating unit and supporting frame to be incorporated in the heating device shown in FIG. 7.

Referring to FIGS. 7 and 8, a heating device 20 employing a heating unit 2*a* of the present invention comprises an impeller 22 having a plurality of blades 26 extending in radial directions from an axis 22A and a motor (not shown) for rotating the impeller 22 about the axis 22A, a housing 30 for enclosing the impeller 22, a duct 24 extending from the housing 30 and the heating unit 2a provided in the duct 24 at a position adjacent to an outlet opening 29 by an U-shaped frame 28 having a large opening 28a, as best shown in FIG. 8. The heating unit 2a is positioned in the duct 24 in such a manner that the PTC semiconductor heating elements 4a to 4d are in parallel relation to the direction of air flow, shown by an arrow R, in the duct 24, so that the air to be heated passes closely by the surfaces 8a and 8b of the heating elements 4a to 4d.

The housing 30 has a plurality of inlet openings 36 formed in the housing 30 approximately on the opposite position to the position where the duct 24 is provided, for taking the air into the housing 30. The heating device 20 further comprises a stay 38 and a stand 40 for supporting the heating device 20. A switch 42 having three alternative positions is provided on the stand 40 for connecting a power source (not shown) with the heating unit 2 through lead wires 32 and 34, which are connected between the corner bar 6c and the frame 28, i.e., between the electrodes 10a and 10b of the heating elements 4a to 4d.

It should be noted that the motor for the impeller 22 is controlled by another suitable switch (not shown) provided in the heating device 20. In the alternative the motor control can be provided by switch 42, in which case the switch 42 must provide three alternative switching conditions; namely: the heating unit and impeller both "on"; only the impeller is "on"; and the heating and impeller are both "off".

During the period when the impeller 22 is on, that is when the air is taken into the housing from the inlet openings 36 and blowing out from the outlet opening 29 through the duct 24 in the direction of the arrow R, the switch 42 is turned on for energizing the heating unit 2a, thus heating the air passing therethrough.

Since each of the heating elements 4a to 4d has two opposed electrodes 10a and 10b directly disposed on the faces 8a and 8b, electrical current flows predominantly in the region near the PTC semiconductor heating body surface between the neighboring strips. Moreover, since the effective heat producing area occupies a comparatively large area on the faces 8a and 8b, each of the PTC semiconductor heating elements consumes electrical power at a high rate for rapidly producing heat therefrom with respect to the electrical current flow. Therefore, little heat is accumulated in the inner region of the PTC semiconductor heating body, and also the air passing through the heating unit 2a efficiently obtains heat from each of the PTC semiconductor heating elements 4a to 4d. For example, when the speed of the air flow is comparatively high, much of the heat from the heating unit 2a is transmitted to the air, while each of the PTC semiconductor heating elements respond rapidly with respect to said heat transmission to generate heat from their respective surfaces to maintain their temperature to a predetermined degree, i.e., each heating element consume electrical power at a high rate to generate more heat by means of an intrinsic self-temperature-adjusting ability, thus the heating unit 2a maintains the temperature of the passing air at a predetermined level.

Since the PTC semiconductor heating elements employed in the heating device 20 do not have an electrical current component flowing in a direction, the PTCS heating elements can be prepared without regard to of thickness. Therefore, it is possible to prepare the PTC semiconductor heating elements in a comparatively thin layer, thus enabling the heating unit in compact size.

According to the experiments carried out by the inventors, the heating unit 2a, using 20 pieces of parallel aligned PTC semiconductor heating elements, maintains the temperature of the blown air at about 80° C., under conditions where the consuming electrical power is 200 watts and the air blowing speed is 5 m/sec. When the air flow ceases, the consuming electrical power is reduced to 25 watts.

Therefore, even if the air flow ceases by accident, each of the PTC semiconductor heating elements automatically reduces its consuming electric power to maintain its predetermined temperature, thus prevented over-heating.

Figure 9:
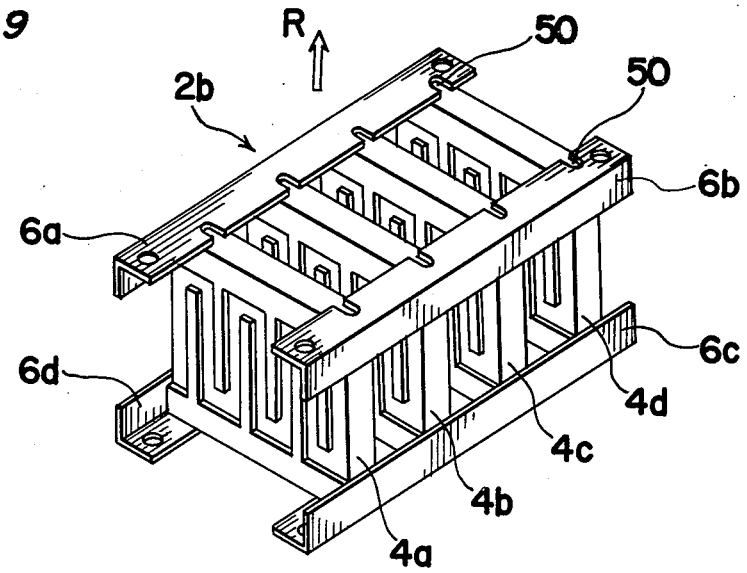
FIGS. 9 and 10 are similar views to FIG. 4, but particularly showing the cut-out portions formed in the corner bars.

Referring to FIG. 9, there is shown a heating unit 2b which is a modification of the heating unit 2a of the above described type. Each of the four corner bars 6a to 6d is provided with notches or concave portions 50 along the edges thereof at positions where said edges contact the electrodes of the PTC semiconductor heating elements 4a to 4d. Each of the concave portions is not as wide as the width of the PTC semiconductor heating elements, so that each of the concave portions 50 can be placed on the perimeter faces of the PTC semiconductor elements.

When constructing the heating unit 2b, each of the PTC semiconductor heating elements 4a to 4d is positioned in a predetermined position by the engagement with the above described recesses 18 or projections 16, and then affixed thereto by means of sputtering, welding or soldering, performed at the notches 50, in which the molten bonding material, such as solder may to contained within the area of the notches, thus simplifying the manufacturing process.

It should be noted that the corner bars can be formed with bores (not shown) instead of the above described notches 50, for obtaining the same effect as those concave portions 50 described above.

Figure 10:
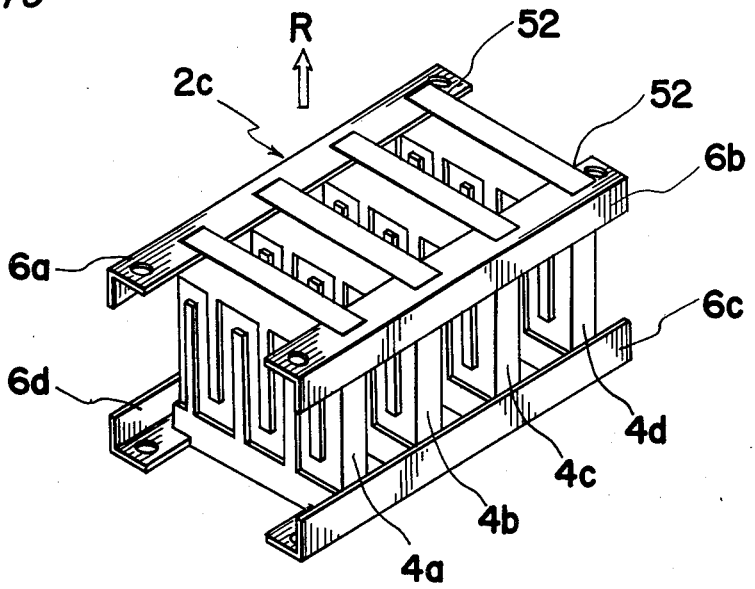

Referring to FIG. 10, there is shown a heating unit 2c which is another modification of the heating unit 2a of the above described type. Instead of forming above described notches 50, the corner bars 6a to 6d are provided with wider concaved portions or cut out portions 52 along the edges thereof at positions where said edges connect with the electrodes of the PTC semiconductor heating elements 4a to 4d. Each of the concave portions 52 is slightly wider than the width of the PTC semiconductor heating elements so that the corner edge portions of the PTC semiconductor heating elements can be engaged in the concave portion 52, thus temporarily holding the PTC semiconductor heating elements 4a to 4d in preferably spaced relations.

Suitable positioned PTCS heating elements 4a to 4d in the corresponding concave portions are then secured by means of sputtering, welding, soldering, flame spraying and the like.

Since the concave portions 52 have the width slightly larger than the width of the PTC heating elements, the PTC semiconductor heating elements can be easily placed into the respective concave portions 52 regardless of the deviations or differences of the thickness of the PTC semiconductor heating elements. Although the above described deviations of the thickness of the PTC semiconductor heating elements may result in gap between the faces of the PTC semiconductor heating element and the edge of the concaved portion 52, such gap can be easily filled with bonding material such as solder, thus the PTC semiconductor heating elements can be fixedly supported by the corner bars in preferable arrangement.

It should be noted that the projections 16 or recesses 18 are not necessary in the corner bars for this embodiment, since the positioning of the PTC semiconductor heating elements are performed by the concave portions 52.

It should also be noted that the above described concave portion 52 can be further formed with burr portions (not shown) along the edge thereof for fixedly holding the PTC semiconductor heating elements at their positions engaging such heating elements within the respective concave portions.

Figure 11:
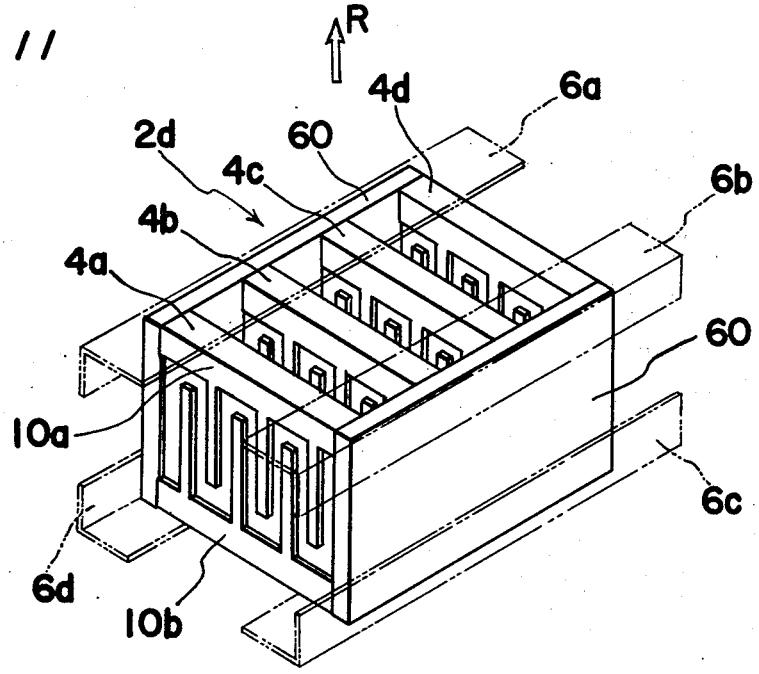
FIG. 11 is a similar view to FIG. 4, but particularly showing the side panels.

Referring to FIG. 11, there is shown a heating unit **2*d* which is a further modification of the above described heating unit 2*a*. In addition to four PTCS heating elements 4*a* to 4*d* aligned in parallel to each other in the above described manner and fixed by the four corner bars 6*a* to 6*d*, the heating unit 2*d* further comprises two sheets of panels or wall members 60, each having a rectangular shape and made of non-conductive material such as synthetic resin, and bonded on the perimeter faces 8*f* and 8*d* of respective PTC semiconductor heating elements. The width of the wall member 60 is the coextensive with the PTC semiconductor heating element and the length thereof is coextensive with or larger than the distance between the arranged PTC semiconductor heating elements 4*a* and 4*d*, which are spaced relation from each other. Such wall members 60 are provided at opposing perimeter faces of the paralely aligned PTC semiconductor heating elements 4*a* to 4*d* in such a manner that the passage designated by the arrow R for the fluid such as air, is enclosed by four walls, i.e., two walls by the PTC semiconductor heating elements and the other two walls by the wall members 60**, thus guiding the air in a more restricted space.

When constructing the heating unit **2*d*, each of the PTC semiconductor heating elements are bonded to the flat surface of the wall members 60, and then the upper and lower perimeter faces of the wall members 60 are coated with electrically conductive material by means of soldering, sputtering, flame spraying or the like for connection to the respective electrodes 10*a* and 10*b* of the PTC semiconductor heating elements. The electric power can be applied to the heating unit 2*d* through the corner bars provided at each of the four corners of the heating unit 2*d*** in the same manner described above.

It should be noted that the wall members 60 described as formed by synthetic resin in the heating unit of FIG. 11 can be replaced by PTC semiconductor heating elements of the above described type in which the fork like strips are provided on the inner face which is facing the passage for providing additional heat producing area, thus more efficiently heating the air passing through the heating unit, as shown in FIG. 12.

Referring to FIG. 12, there is shown a heating unit **2*e* which is a still further modification of the above described heating unit 2*a*. The heating unit 2*e* in this embodiment comprises four PTC semiconductor heating elements 4*a* to 4*d* and the two wall members 60 arranged in the same manner described above in connection with FIG. 11. The heating unit 2*e* further comprises an insulating means 70 entirely coated around each of the PTC semiconductor heating elements and the wall members 60, except four corner portions 62, 64, 66 and 68 of the upper peripheral edge of the heating unit 2*e* and four corner portion (can not be seen in FIG. 12) of the lower peripheral edge of the same and rectangular shaped upper and lower frames 72 and 74 made of metal plates. Each of the frames 72 and 74 has projections 76 at its four corners for electrically connecting the electrodes 10*a* and 10*b* with the upper and lower frames 72 and 74, respectively, through the above described corner portions, when placing the frames 72 and 74 onto the perimeter faces of the wall members 60. Such frames 72 and 74 can be fixedly provided on the perimeter faces of the wall members 60 by any securing means such as securing screws or bonding. The corner bars 6*a* to 6*d* (not shown in FIG. 12**) can be provided at each corners in the above described manner.

Such insulating means 70 is particularly suitable for preventing the PTC semiconductor heating elements from deterioration which is often caused by the moisture or chemical substances contained in the fluid to be heated. Thus, the heating unit **2*e*** of the above described type will not be affected by the fluid containing underiable components.

Furthermore, notwithstanding the insulating means covering the heating elements, the electrodes of the heating unit can be easily supplied with electrical power by a simple structure.

Since the heating unit of the present invention employs PTC semiconductor heating elements with the heat producing origin existing on the opposing flat faces thereof, the PTC semiconductor heating elements rapidly produces heat therefrom with repsect to the applied electric power and the PTC semiconductor heating element maintains its temperature to a predetermined degree without undesirable fluctuation, and therefore, the fluid passing through the heating unit can be heated efficiently and rapidly.

It should be noted that although the heating units of the invention are mainly described for use in heating gas such as air, it is possible to utilize heating unit of the present invention to be employed in a device for heating liquids by completely coating the heating unit with electrical insulating material.

Although the present invention has been fully described by way of examples with reference to the accompanying drawings, it is to be noted that various changes and modification are apparent to those skilled in the art. Therefore, unless such changes and modifications depart from the scope of the present invention, they should be construed as included therein.

What is claimed is:

1. A heating unit for heating fluid comprising;

a plurality of PTC semiconductor elements each comprising a PTC semiconductor heating body having two opposite flat surfaces parallel to each other and four corners formed at the periphery thereof, an electrode assembly bonded on at least one of said two opposite flat surfaces, said electrode assembly being constituted by first and second sets of electrodes, each set having a plurality of spaced finger-like strips which are electrically connected to each other at one end thereof said strips being disposed in such a manner that neighboring strips are members of the opposite first or second set of electrodes, and first and second terminals bonded on said periphery of said heating body in electrically insulated relation to each other, said first and second terminals being connected to said first and second sets of electrodes, respectively; and supporting means including two pairs of bar members each made of electrically conductive material and having an L-shaped cross sectional configuration, said bar members of one pair being connected to an adjacent two of four corners of each of said elements and said bar members of the other pair being connected to the remaining two corners of each of said elements for supporting said plurality of PTC semiconductor elements in face to face relation to each other and for electrically connecting said first terminals of said elements to each other by said bar members of one pair and electrically connecting said second terminals of said elements to each other by said bar members of said other pair, said supporting means further including means for positioning said PTC semiconductor elements at spaced apart predetermined distances to define a passage for fluid to pass between adjacent members of said PTC semiconductor elements, said PTC semiconductor elements being secured to said bar members for rigid connection therebetween.

2. A heating unit as claimed in claim 1, wherein said first terminal is extended on said periphery between said adjacent two of four corners and said second terminal being extended on said periphery between said remaining two corners.

3. A heating unit as claimed in claim 1, wherein said means for positioning comprises a plurality of projections formed on the inner surfaces of said L-shaped bar members for holding said PTC semiconductor element therebetween.

4. A heating unit as claimed in claim 1, wherein said means for positioning comprises a plurality of recesses formed on the inner surfaces of said L-shaped bar members for holding said PTC semiconductor elements therein.

5. A heating unit as claimed in claim 1, wherein said means for positioning comprises a plurality of cut-out portions formed along the edge portions of said L-shaped bar members, said cut-out portions having U-size thereof slightly larger than the thickness of said PTC semiconductor elements.

6. A heating unit as claimed in claim 1, wherein said securing between said PTC semiconductor elements and said bar members is effected by a plurality of cut-out portions formed along the edge portions of said bar members, said cut-out portions having a size thereof commensurate with the thickness of said PTC semiconductor element at positions where the bar members engage with said PTC semiconductor elements, said cut-out portions being filled with bonding material.

7. A heating unit as claimed in claim 1, wherein said electrode assembly is bonded to both of said two opposite flat surfaces.

8. A heating unit as claimed in claim 7 wherein finger-like strips of the same electrical potential of said electrode assemblies on said two opposite flat surfaces are in registry through said heating body, whereby no electrical current component is generated through said heating body in a direction substantially perpendicular to said opposite flat surfaces.

* * * * *